US006293857B1

(12) United States Patent
Allard

(10) Patent No.: US 6,293,857 B1
(45) Date of Patent: Sep. 25, 2001

(54) BLAST NOZZLE

(75) Inventor: James J. Allard, Vacaville, CA (US)

(73) Assignee: Robert Pauli, Fairfield, CA (US)

( * ) Notice: Subject to any disclaimer, the term of this patent is extended or adjusted under 35 U.S.C. 154(b) by 0 days.

(21) Appl. No.: 09/287,532

(22) Filed: Apr. 6, 1999

(51) Int. Cl.[7] ..... B24C 5/04
(52) U.S. Cl. ..... 451/102; 451/75; 451/90
(58) Field of Search ..... 451/75, 90, 102

(56) References Cited

U.S. PATENT DOCUMENTS

| | | | | |
|---|---|---|---|---|
| Re. 34,854 | | 2/1995 | Shank, Jr. | 451/102 |
| 4,633,623 | * | 1/1987 | Spitz | 451/102 |
| 4,817,342 | * | 4/1989 | Martin et al. | 451/102 |
| 5,036,631 | * | 8/1991 | Stoltz | 451/102 |
| 5,265,383 | * | 11/1993 | Shank, Jr. | 451/102 |
| 5,283,990 | | 2/1994 | Shank, Jr. | 451/90 |
| 5,484,325 | * | 1/1996 | Shank | 451/38 |
| 5,487,695 | * | 1/1996 | Shank | 451/102 |
| 5,509,849 | * | 4/1996 | Spears et al. | 451/40 |
| 5,545,073 | * | 8/1996 | Kneisel et al. | 451/39 |
| 5,616,067 | | 4/1997 | Goenka | 451/39 |
| 5,626,508 | | 5/1997 | Rankin et al. | 451/102 |
| 5,690,543 | * | 11/1997 | Curran | 451/76 |
| 5,704,825 | * | 1/1998 | LeCompte | 451/102 |
| 5,975,996 | * | 11/1999 | Settles | 451/102 |

FOREIGN PATENT DOCUMENTS

| | | |
|---|---|---|
| 2712826 | 2/1995 | (FR) . |
| 8900809 | 1/1990 | (NL) . |

OTHER PUBLICATIONS

D. Monette, "Starch Media Dry Stripping (SMDS), Advanced application techniques and equipment to optimise aerospace coating removal operations", presented at the DOD/Industry Advanced Coating Conference, May 14, 1997, Las Vegas, Nevada.

* cited by examiner

*Primary Examiner*—Allen Ostrager
*Assistant Examiner*—William Hong
(74) *Attorney, Agent, or Firm*—Flehr Hohbach Test Albritton & Herbert LLP

(57) ABSTRACT

A blast nozzle apparatus which includes a circular inlet to an entry portion with converging top and bottom surfaces and diverging side surfaces which terminate in a throat portion and an outlet portion including diverging side surfaces and top and bottom surfaces terminating in a substantially rectangular outlet opening.

10 Claims, 4 Drawing Sheets

BLAST NOZZLE

BRIEF DESCRIPTION OF THE INVENTION

This invention relates generally to blast nozzles for cleaning surfaces using abrasive particles propelled by air. More particularly, this invention relates to a novel blast nozzle that provides a uniform concentration of blast particles in a rectangular pattern, with maximum blast area and minimum over-blast, for use in removing coatings from composite materials and metallic surfaces such as aluminum and titanium surfaces on aircraft.

BACKGROUND OF THE INVENTION

1. Field of the Invention

In order to clean a surface for recoating, the technique of using fluid blasting of abrasive particles against a surface has been used. Additionally, blasting techniques have evolved using dry blasting. Dry blasting is comprised of directing a stream of pressurized air containing abrasive media toward the desired surface. Typical air pressures range from 15 to 150 psi.

A typical dry blasting apparatus comprises a dispensing portion, a flexible hose, and a blast nozzle. The dispensing apparatus in which the blast media is contained is a storage tank combined with pressurized air. The flexible hose carries the air/blast media mixture to the blast nozzle and allows the operator to move the blast nozzle relative to the surface to be cleaned. The blast nozzle accelerates the abrasive blast media and directs it into contact with the surface to be treated.

Several factors dictate the efficacy of coating removal. Among those factors are the angle of the nozzle relative to the surface and the distance from the surface. Naturally, effective nozzle positioning will result in optimal speed of coating removal. However, a further factor to consider is the shape of the blast pattern. Nonuniformity of blast media discharge from the nozzle often results in a "hot spot" in the pattern, which is the area of maximum blast media striking the surface being treated at a given moment. A non-uniform blast pattern allows particles to strike already cleaned surfaces which may damage the surfaces and further results in the waste of blast media and compressed air energy. Dispersal of blast media throughout the nozzle is largely governed by the shape of the internal nozzle geometry.

FIGS. 1 and 2 illustrate a blast nozzle in accordance with a prior art example. A cylindrical inlet 4 connects to entry chamber 6 formed by side walls 7 and converging upper and lower walls 8 and 9. The chamber 6 terminates in a throat 10. Following the chamber 6 is a blast chamber 12. The chamber 12 has diverging top and bottom walls 14 and 16, and diverging side walls 18 and 20, to form a rectangular outlet. There is an abrupt change from the cylindrical input to the rectangular entry chamber which causes disrupted flow of particles and a non-uniform output pattern at the output of the blast chamber 12 which results in non-uniform coating removal and the necessity to overlap the stripping path. Overlapping the blasting pattern can result in damaging the surface by blasting previously cleaned surfaces.

Prior art focused on expanding a circular or square hot spot in order to increase efficiency. However, a larger circle or square hot spot is redundant due to the fact that coating removal occurs in a sweeping motion and the real issue regarding efficiency is the width and uniformity of the blast pattern. A long, narrow, rectangular, uniform pattern results in greater efficiency in providing a maximum blast area with evenly distributed particles, which reduces the need to overlap the stripping path, thereby increasing the efficiency and reducing the opportunity to damage the surface.

2. Description of the Prior Art

Different types of nozzles using different shapes are well known in the prior art. These nozzles fail to address the problem described.

U.S. Pat. No. Re. 34,854 to Shank, Jr. shows a fan nozzle with converging, triangular ramps.

U.S. Pat. No. 5,283,990 to Shank, Jr. shows a blast nozzle with a flow straightener intermediate the input and the blast nozzle.

U.S. Pat. No. 5,704,825 to LeCompte shows an inlet portion, an outlet portion and a square venturi orifice connecting the inlet and outlet portions.

In view of the foregoing, it would be highly desirable to provide a long, narrow uniform blast pattern with no hot spot. Such a pattern would represent uniformity of blast media throughout the nozzle and maximum efficiency for surface cleaning.

OBJECTS AND SUMMARY OF THE INVENTION

It is a general object of the present invention to provide a blast nozzle for cleaning coatings and other adherents off of a surface with plastic or starch particles or other abrasive blast media.

It is another object of the invention to provide a blast nozzle with a high degree of efficiency.

It is a further object of the invention to provide a blast nozzle with no hot spot and a wide, rectangular dispersion pattern for blast media.

The foregoing and other objects of the invention are achieved by a blast nozzle with an inlet, an entry chamber, a throat portion, an outlet portion, and an outlet. The inlet is substantially circular and immediately leads to the entry chamber. The entry chamber begins at a point immediately adjacent to the inlet. The top and bottom surfaces of the entry chamber smoothly and continuously converge towards one another, while the side surfaces of the entry chamber diverge from one another. The top and bottom surfaces cease converging at the end of the entry chamber, which is the point of minimum cross-section area, called the throat. The outlet portion contains an outlet passage diverging from the throat. The surfaces defined in the throat portion continue in the outlet portion. The top and bottom surfaces may, but do not necessarily, diverge along the outlet portion, as do the side surfaces. The outlet portion diverges primarily due to the constant and continuous divergence of the side surfaces throughout the entire blast nozzle.

BRIEF DESCRIPTION OF THE DRAWINGS

The foregoing and other objects will be more clearly understood from the following description when read in connection with the accompanying drawings of which.

DESCRIPTION OF PREFERRED EMBODIMENT

Figure 1:
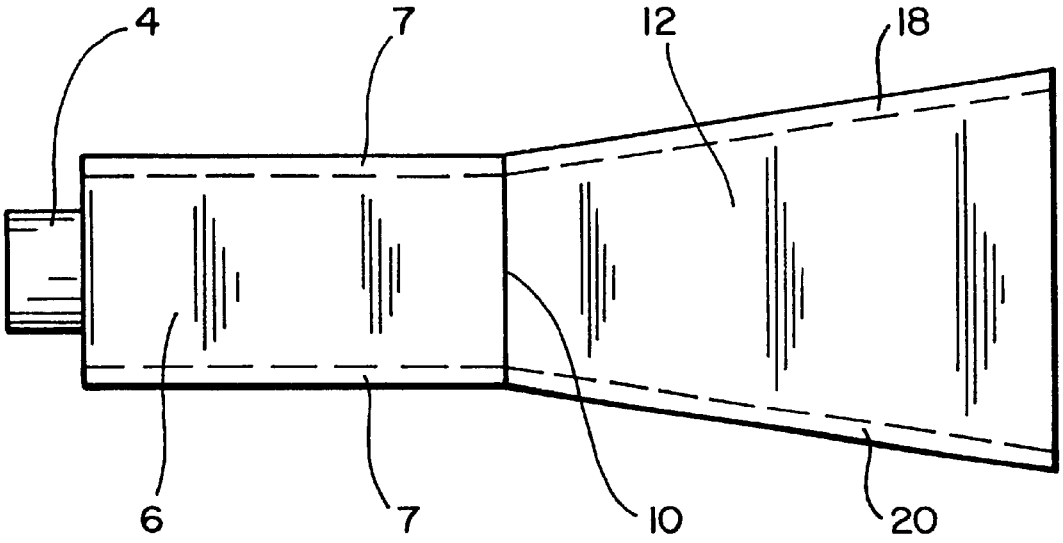
FIG 1 (PRIOR ART)
FIG. 1 is a stop plan view of an example of the blast channel of a nozzle in the prior art.
Figure 2:
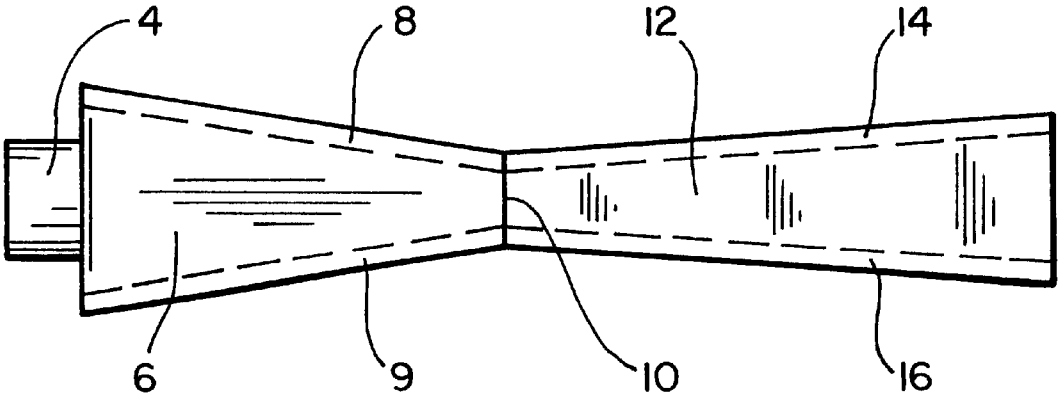
FIG 2 (PRIOR ART)
FIG. 2 is a side elevational view of the nozzle of FIG. 1.
Figure 3:
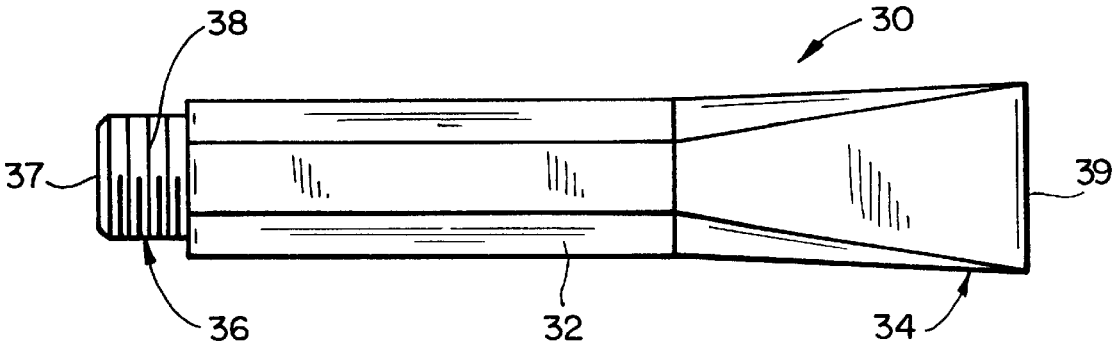
FIG. 3 is a plan view of a nozzle apparatus constructed in accordance with the present invention.
Figure 4:
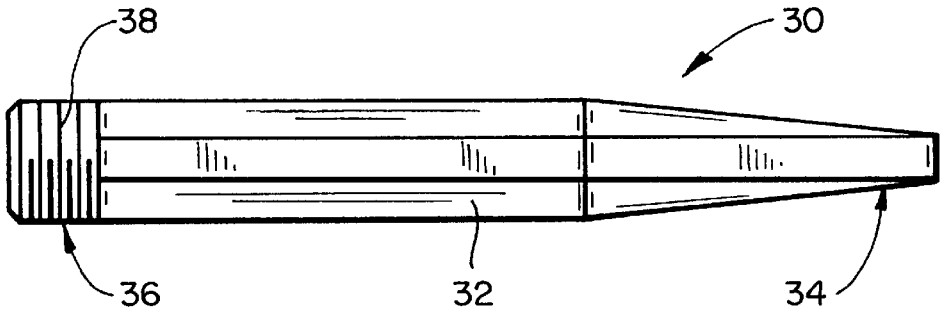
FIG. 4 is a side view of the nozzle apparatus constructed in accordance with the present invention.
Figure 7:
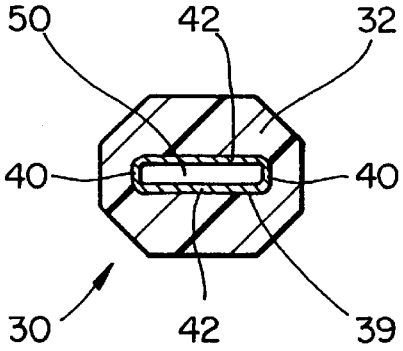
FIG. 7 is a sectional view taken along line 7—7 of FIG. 6 showing the interior of the blast nozzle apparatus.

FIGS. 3 and 4 are top and side views of a blast nozzle apparatus 30 constructed in accordance with an embodiment of the invention. The nozzle apparatus 30 includes a jacket 32 made from urethane and molded around a wear resistant nozzle 33 such as stainless steel, tungsten, carbide or boron carbide (See FIGS. 10 and 11). In one example, the nozzle 33 was stamped from sheet material. The length of the blast nozzle apparatus 30 was 12 inches, the width and height at its outlet end 34 were 2.5 inches and 0.63 inches, respectively, while the diameter at its inlet end 36 was 1.58 inches. It will be apparent that nozzles having other dimensions can be fabricated and operate in accordance with the present invention. The inlet end 36 had threads 38 for attaching to a pipe or hose that supplies abrasive blast media. A circular inlet 37 is located at the inlet end 36. In the present example, the inside diameter of the circular inlet 37 was approximately one inch. The length of the part of the nozzle 34 with threads 38 was 1.25 inches. A substantially rectangular blast media outlet 39, seen more clearly in FIG. 7, is located at the outlet end 34.

Figure 5:
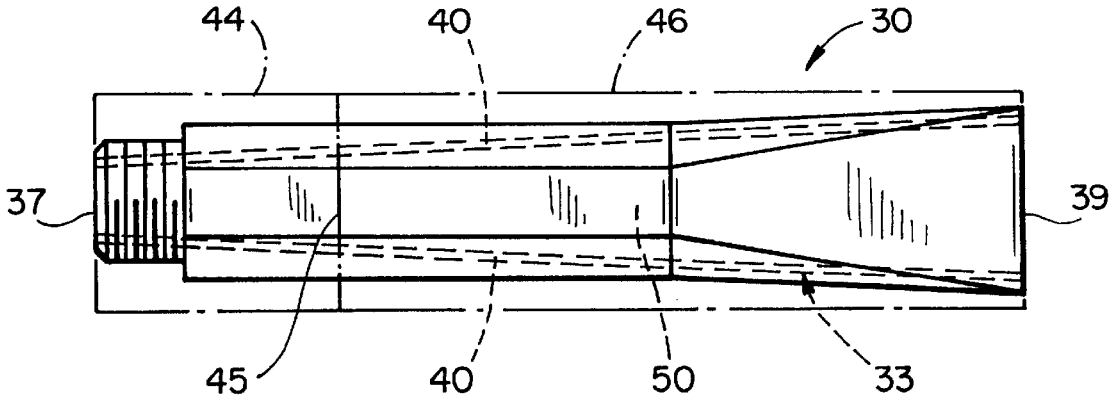
FIG. 5 is a stop plan view of the nozzle apparatus showing in dotted lines the shape of the interior blast passage.

FIG. 5, the top view, shows the side walls 40 of the nozzle 33 within the jacket 32. This view of the nozzle shows the side wall 40 continuously and smoothly diverging in a straight line from the inlet 37 throughout the entire length of the nozzle to the outlet 39. The side walls have a smooth curvature, FIG. 9. It is important that the divergence be smooth and continuous throughout the length of the nozzle. Although the passage 50 within the nozzle 33 progresses from a circular inlet 37 to a rectangular outlet 39, the side walls 40 diverge continuously. The entry portion 44 of the nozzle is shown by dotted line block 44 in relation to the outlet portion of the nozzle shown by dotted line block 46.

Figure 6:
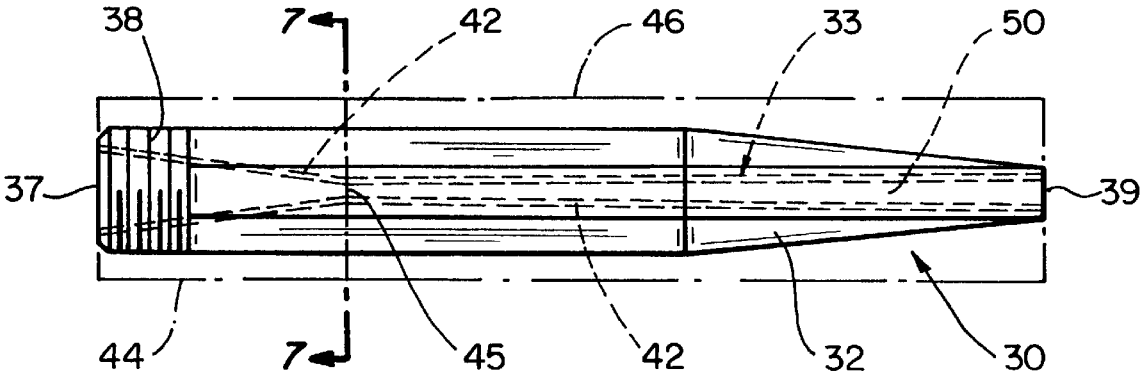
FIG. 6 is a side plan view of the nozzle apparatus showing in dotted lines the shape of the nozzle and interior blast passage.

FIG. 6 shows a side view of the nozzle 33 within the jacket 32. The top and bottom walls 42 of the passage 50 are evident within the nozzle apparatus 30. The beginning of the entry portion 44 is immediately adjacent to the inlet 37. The end of the entry portion 44 is the throat 45, and is immediately adjacent to the outlet portion 46. A cross-section of the inlet 37 is circular. A cross-section of entry portion 44 is not elliptical in a mathematical sense, but the smoothly converging top and bottom walls 42 combined with diverging side walls 40 (see FIG. 5) form an oblong, ellipse-like cross-section throughout the entry portion 44. The point at which the top and bottom walls 42 cease converging marks the end of the entry portion 44 and the beginning of the outlet portion 46. This point defines the throat 45 of the nozzle.

The outlet portion 46 begins when the top and bottom walls 42 cease converging and begin diverging. The degree of divergence is slight between the top and bottom walls 42 in comparison to the side walls 40 (see FIG. 5). The side walls 40 diverge smoothly and continuously throughout the entire nozzle, including the outlet portion 46. The outlet portion 46 ends at the outlet 39. In another embodiment, the top and bottom walls were parallel.

FIG. 7 shows the inside of the nozzle apparatus 30 shown in FIG. 6 by a cross-sectional view at the throat taken from along the line 7—7. The cross-sectional area shows the beginning of the outlet portion 46, looking into the entry portion 44. FIG. 7 is identified as the beginning of the outlet portion 46 because the top and bottom walls 42 are flat and the passage 50 is substantially rectangular in shape. The side walls 40 are evident as well as the top and bottom walls 42. The jacket 32 surrounds the nozzle 34.

Figure 8:
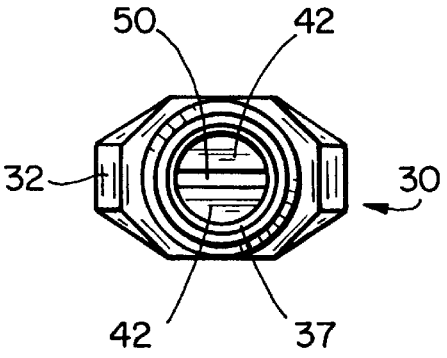
FIG. 8 is an end view of the nozzle apparatus showing the inlet.

The circular inlet 37 is visible in the end view, FIG. 8. The inlet 37 leads into the converging top and bottom walls 42 of the entry portion 44. The structure of the jacket 32 is evident around the nozzle 33, which forms the blast passage 50.

Figure 9:
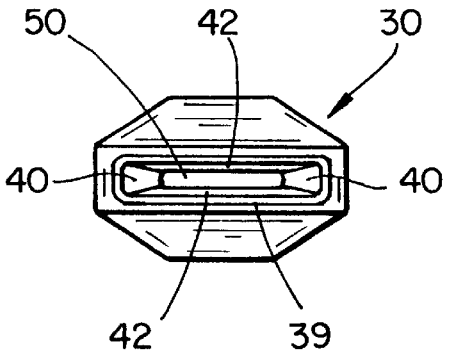
FIG. 9 is an enlarged end view of the nozzle apparatus showing the outlet.

The enlarged end view, FIG. 9, shows the substantially rectangular outlet 39 of the nozzle 33. The top and bottom walls 42 can be seen slightly diverging, while a greater degree of divergence is evident in the side walls 40. The side walls 40 are rounded or curved. The sum of the surfaces seen in FIG. 9 is the outlet portion 46 (see FIG. 6), connecting to the outlet 39 and forming the blast passage 50.

Figure 10:
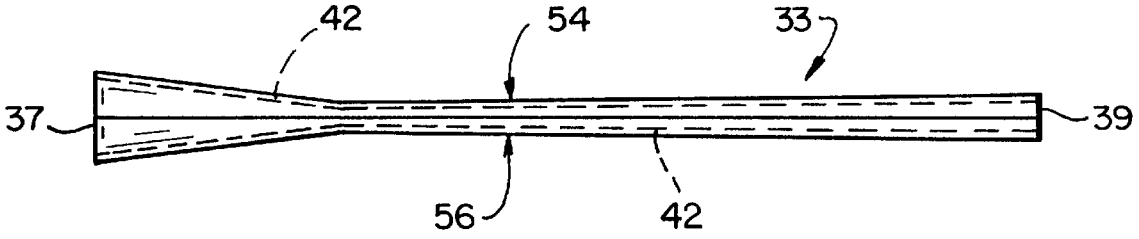
FIG. 10 is a side plan view of a nozzle used in the nozzle apparatus.
Figure 11:
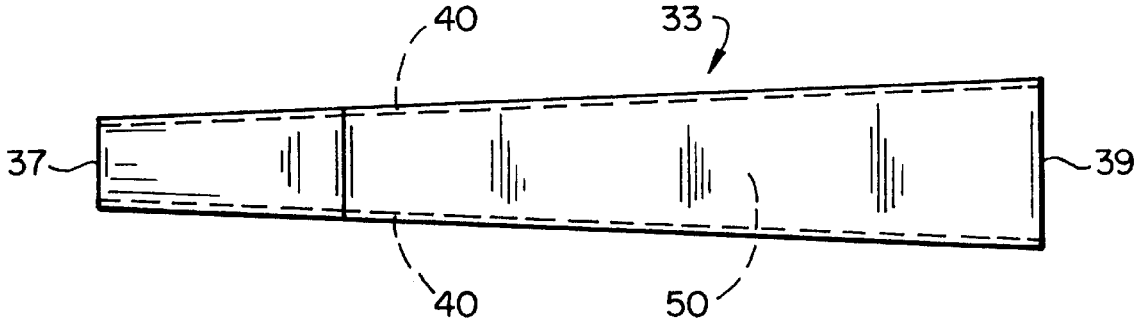
FIG. 11 is a top plan view of a nozzle used in the nozzle apparatus.

FIG. 10 shows a side view of a blast nozzle 33 constructed in accordance with an embodiment of the present invention. The nozzle 33 consists of an upper half 54 and a lower half 56, each stamped from annealed wear resistant metal. The upper half 54 and lower half 56 are welded together and heat treated, and the jacket 32 (shown in FIG. 3) is molded around the nozzle 33. Moving from the inlet 37 to the outlet 39, the top and bottom surfaces 42 converge for approximately three inches of the overall length of the nozzle 33, and then diverge for the remaining nine inches. The height of the outlet 39 is approximately one-quarter of an inch. The height of the blast channel between the top and bottom surfaces 42 varies throughout the nozzle 33, regardless of the axis of measurement (see FIG. 10). FIG. 11 illustrates the nozzle 33 and the blast passage 50 formed by the side walls 40.

In order to operate the blast nozzle a media supply hose (not pictured) is secured to the threads 38 (see FIGS. 3 and 4) on the nozzle 30. Air pressure forces blast media particles through the hose and past the inlet 37 of the nozzle 30. The particles follow the blast passage 50 and exit through the outlet 39. The shape of the blast passage 50 insures that the surface pattern produced by the exiting blast media is long, narrow, and uniform in concentration.

Figure 12:
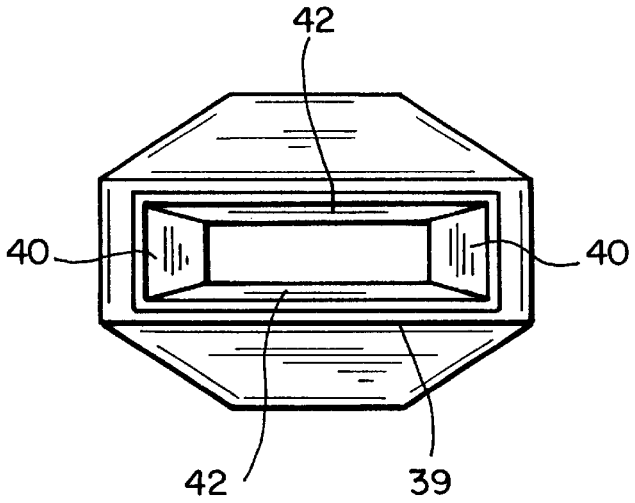
FIG. 12 is further embodiment of the invention utilizing a rectangular outlet with flat side walls.

A further embodiment of the present invention appears in FIG. 12. It has right angles at the junction of the side walls 40 the top and bottom walls 42. Right angles extending through the outlet portion 46 to the outlet 39 results in an outlet with a well-defined rectangular shape. The round side walls at the throat transition to flat walls.

The foregoing description, for purposes of explanation, used scientific nomenclature to provide a thorough understanding of the invention. However, it will be apparent to one skilled in the art that the specific details are not required in order to practice the invention. The foregoing descriptions of specific embodiments of the present invention are presented for purposes of illustration and description. They are not intended to be exhaustive or to limit the invention to the precise forms disclosed, obviously many modifications and variations are possible in view of the above teachings. The embodiments were chosen and described in order to best explain the principles of the invention and its practical applications, to thereby enable others skilled the art to best utilize the invention and various embodiments with various modifications as are suited to the particular use contemplated. It is intended that the scope of the invention be defined by the following claims and their equivalents.

What is claimed is:

1. A blast nozzle for cleaning or treating a surface with a blast media, comprising:

an inlet for receiving blast media, an entry portion comprising a transition between said inlet and a throat, an outlet portion terminating in a substantially rectangular opening, said throat located between said inlet and said outlet, said entry portion marked by a substantially circular cross section near said inlet and ending in a substantially rectangular cross section near said throat, having one dimension greater than the diameter of the circular cross sections said transition between said inlet and said throat occurring in a smooth and continuous diverging and converging manner, a cross section of said throat having smaller dimensions than said substantially rectangular opening terminating said outlet portion; and a cross-section of the blast nozzle between the throat and the outlet having a substantially rectangular shape.

2. The blast nozzle of claim 1 wherein said entry portion comprises a beginning, an ending, side surfaces, and top and bottom surfaces, said beginning in communication with said inlet and said ending in communication with said throat portion, said side surfaces diverge away from one another, from said inlet to said throat, while said top and bottom surfaces converge towards one another, from said inlet to said throat, creating an interior within the blast nozzle that rapidly and smoothly transitions from a substantially circular inlet to a substantially rectangular throat, the sides of which are wider than the diameter of the substantially circular inlet due to the diverging side walls, the to and bottom of which are narrower than the diameter of the substantially circular inlet due to the conversing top and bottom surfaces.

3. The blast nozzle of claim 1 wherein said inlet is intended for receiving a mixture of pressurized air and blast media.

4. The blast nozzle of claim 2 wherein said nozzle is contained within a jacket.

5. The blast nozzle of claim 1 wherein said outlet portion is formed by at least a pair of side surface and a pair of top and bottom surfaces, said side surfaces diverging form said inlet to said rectangular opening.

6. The blast nozzle of claim 5 wherein said top and bottom surfaces diverge from said throat to said opening, said outlet passage diverging primarily by means of said side surfaces.

7. The blast nozzle of claim 5 wherein said top and bottom surfaces are substantially parallel.

8. A blast nozzle for cleaning a surface with an abrasive blast media, comprising:

a substantially circular inlet for receiving a mixture of pressurized air and said abrasive, an entry portion comprising a transition between said inlet and a substantially rectangular throat portion, an outlet portion terminating in a substantially rectangular opening, said entry portion comprising top, bottom and side surfaces, said entry portion in communication with said inlet and said throat portion, said top and bottom surfaces continuously and smoothly converging towards one another from said inlet to said throat, and ceasing to converge at said throat portion, said side surfaces continuously diverging away from one another from said inlet to said throat, said transition between said inlet and said throat portion occurring in a smooth and continuous manner, said outlet portion comprising a pair of side surfaces and a pair of top and bottom surfaces, said side surfaces diverging away from one another from said throat portion to said outlet, said top and bottom surfaces diverging away from one another from said throat to said outlet, said outlet passage diverging primarily by means of said side surfaces.

9. The blast nozzle of claim 8 wherein said nozzle is contained within a jacket.

10. The blast nozzle of claim 9 wherein said jacket is made from urethane.

* * * * *